US008747154B2

(12) United States Patent
Uchiyama

(10) Patent No.: US 8,747,154 B2
(45) Date of Patent: Jun. 10, 2014

(54) WATERPROOF CONNECTOR

(75) Inventor: Yoshihiro Uchiyama, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 36 days.

(21) Appl. No.: 13/465,093

(22) Filed: May 7, 2012

(65) Prior Publication Data

US 2012/0322305 A1 Dec. 20, 2012

(30) Foreign Application Priority Data

Jun. 17, 2011 (JP) ..... 2011-135664

(51) Int. Cl.
*H01R 13/40* (2006.01)

(52) U.S. Cl.
USPC ..... 439/587

(58) Field of Classification Search
USPC ..... 439/587, 589, 274, 275
See application file for complete search history.

(56) References Cited

U.S. PATENT DOCUMENTS 6,692,301 B2 * 2/2004 Okayasu et al. ..... 439/587
7,572,142 B2 8/2009 Katsuma

* cited by examiner

*Primary Examiner* — Phuong Dinh
(74) *Attorney, Agent, or Firm* — Gerald E. Hespos; Michael J. Porco; Matthew T. Hespos

(57) ABSTRACT

A waterproof connector has a housing (2) for accommodating terminal fittings (1) connected to ends of wires (W). An engaging portion (28) is formed on the outer surface of the housing (2). A one-piece rubber plug (15) is mounted in a rear part of the housing (2) to collectively seal the wires (W). A holder (20) is fit to the rear part of the housing (2) to retain the one-piece rubber plug (15) and a cover (27) is arranged on a rear part of the holder (20). The holder (20) is formed with an opening (46) for exposing the engaging portion (28) if the holder (20) is mounted properly on the housing (2) and the cover (27) is formed with a lock (57) that can engage the exposed engaging portion (28).

14 Claims, 19 Drawing Sheets

WATERPROOF CONNECTOR

BACKGROUND OF THE INVENTION

1. Field of the Invention

The invention relates to a waterproof connector.

2. Description of the Related Art U.S. Pat. No. 7,572,142 discloses a known waterproof connector with a housing and a tubular accommodating portion at a rear part of the housing. A one-piece rubber plug is accommodated in the tubular accommodating portion for collectively sealing a plurality of wires and a rear holder mounted on outer side surfaces of the tubular accommodating portion for retaining the one-piece rubber plug.

A wire cover conventionally is mounted on a housing when wires pulled out from the housing need to be forcibly directed in a specified direction. The wires then are led along the inner surface shape of the cover. A locking structure for the wire cover can be set in a tubular part of the rear holder since this tubular part is fit on the rear part of the housing from the outer side. However, if the wire cover is mounted on the rear holder, a holding force may be smaller than if the wire cover is mounted directly on the housing.

The present invention was completed based on the above situation and an object thereof is to increase a holding force for a wire cover in a waterproof connector including a rear holder for a one-piece rubber plug.

SUMMARY OF THE INVENTION

The present invention is directed to a waterproof connector in which wires are sealed collectively. The connector has a housing for accommodating terminal fittings connected to ends of the respective wires. A one-piece rubber plug is mounted into a rear part of the housing to collectively seal the wires. A holder includes a fitting portion that is fit on outer side surfaces of the rear part of the housing and is adapted to retain the one-piece rubber plug and a cover arranged on a rear part of the holder. An engaging portion is formed on the outer surface of the housing. The holder is formed with an opening for exposing the engaging portion when the holder is mounted properly on the housing and the cover is formed with a lock that engages the exposed engaging portion. Thus, the cover can be mounted with a larger holding force as compared with the case where the cover is mounted on the holder.

The opening preferably exposes the entire engaging portion to make the engaging portion engageable with the lock when the holder is mounted properly on the housing. However, an incompletely mounted holder at least partly covers the engaging portion and prevents the lock from engaging the engaging portion. Thus, proper mounting of the holder can be confirmed based on whether or not the cover can be mounted.

The holder preferably is mounted on the housing to be displaceable between a partial locking position where the holder is spaced back from the one-piece rubber plug and a full locking position where the holder closely contacts the rear surface of the one-piece rubber plug. The opening is at a position so that the engaging portion cannot engage the lock when the holder is at the partial locking position. However, the opening is at a position so that the engaging portion can engage the lock when the holder is at the full locking position. Thus, the lock and the engaging portion cannot be engaged until the holder is brought to the full locking position The lock preferably projects forward in a mounting direction of the cover and a guiding edge is formed on the opening edge of the opening along the mounting direction of the cover. The guiding edge slides in contact with the lock when the cover is mounted to guide a mounting movement of the cover so that the cover can be mounted smoothly.

A projecting portion and a positioning recess are formed on facing surfaces of the cover and the holder in a mounting direction of the cover and are engageable with each other when the cover is mounted on the housing. Thus, the cover cannot displace relative to the holder in a direction crossing the mounting direction.

A seal ring preferably is mounted on the outer peripheral surface of the housing and a pressing edge is formed on the front end edge of the fitting portion in the mounting direction. The pressing edge faces the rear edge of the seal ring in the mounting direction when the holder is mounted properly on the housing for retaining the seal ring. Thus, the holder can retain both the one-piece rubber plug and the seal ring.

DETAILED DESCRIPTION OF THE PREFERRED EMBODIMENTS

Figure 13:
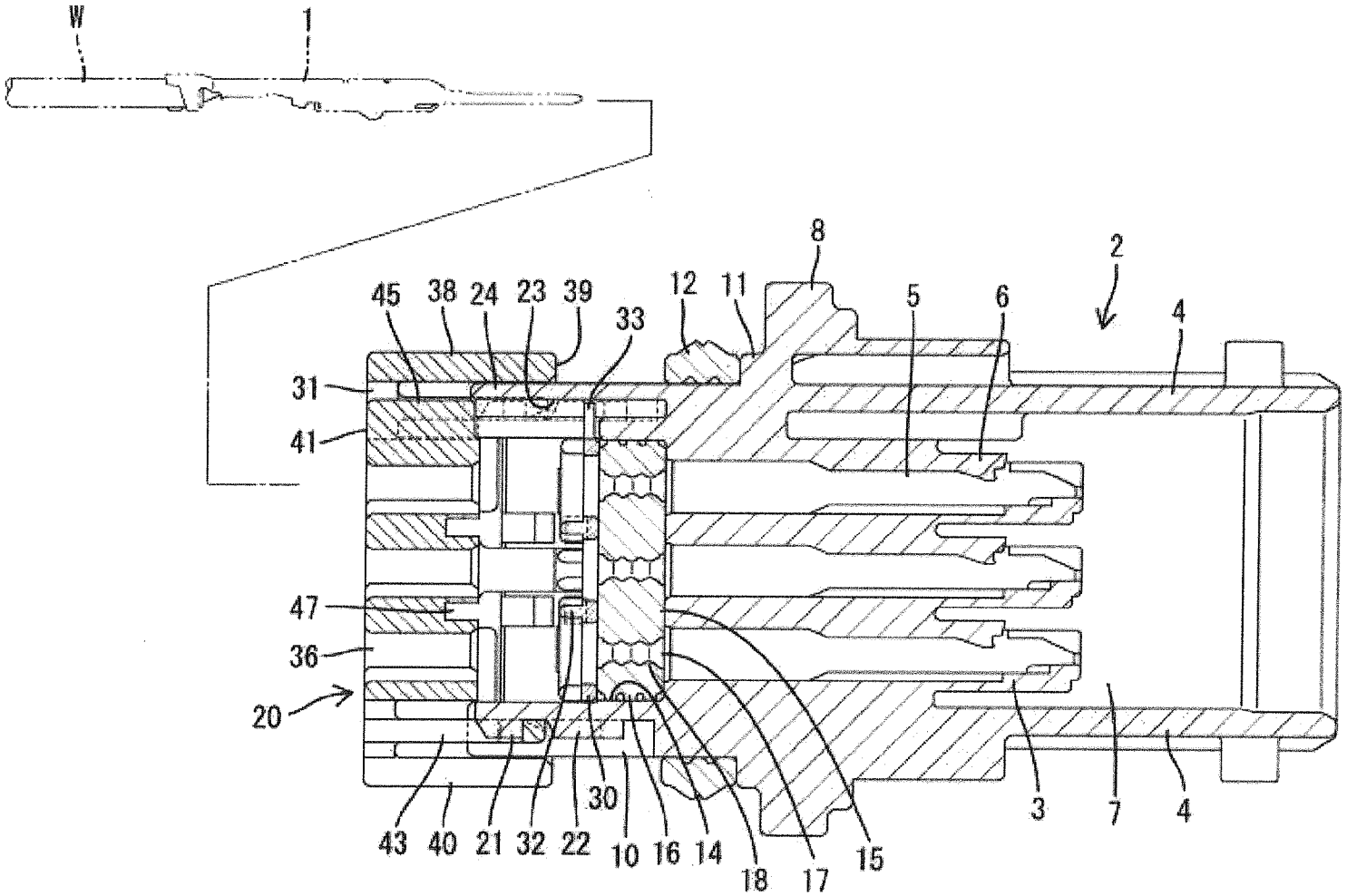
FIG. 13 is a section along A-A of FIG. 11 showing the state of FIG. 11.

A waterproof connector according to this embodiment includes a male plurality of terminal fittings 1 accommodated in a housing 2. The housing 2 is made of synthetic resin and has opposite front and rear ends. A terminal accommodating portion 3 is formed at a front part and a rectangular tubular receptacle 4 surrounds the terminal accommodating portion 3, as shown in FIG. 13. Cavities 5 extend in forward and backward directions through the terminal accommodating portion 3 and the male terminal fittings 1 are held in the respective cavities 5 by locking lances 6 so that leading ends of the terminal fittings 1 project into the receptacle 4. A connection space 7 is formed between the terminal accommodating portion 3 and the receptacle 4 and can receive an unillustrated female connector housing.

A flange 8 bulges out in a substantially central part of the outer surface of the housing 1 in forward and backward directions and is used to mount the waterproof connector on a panel P. Bolt insertion holes 9 are formed at diagonal positions of the mounting flange 8 to bolt the waterproof connector to the panel P (see FIG. 11).

Figure 11:
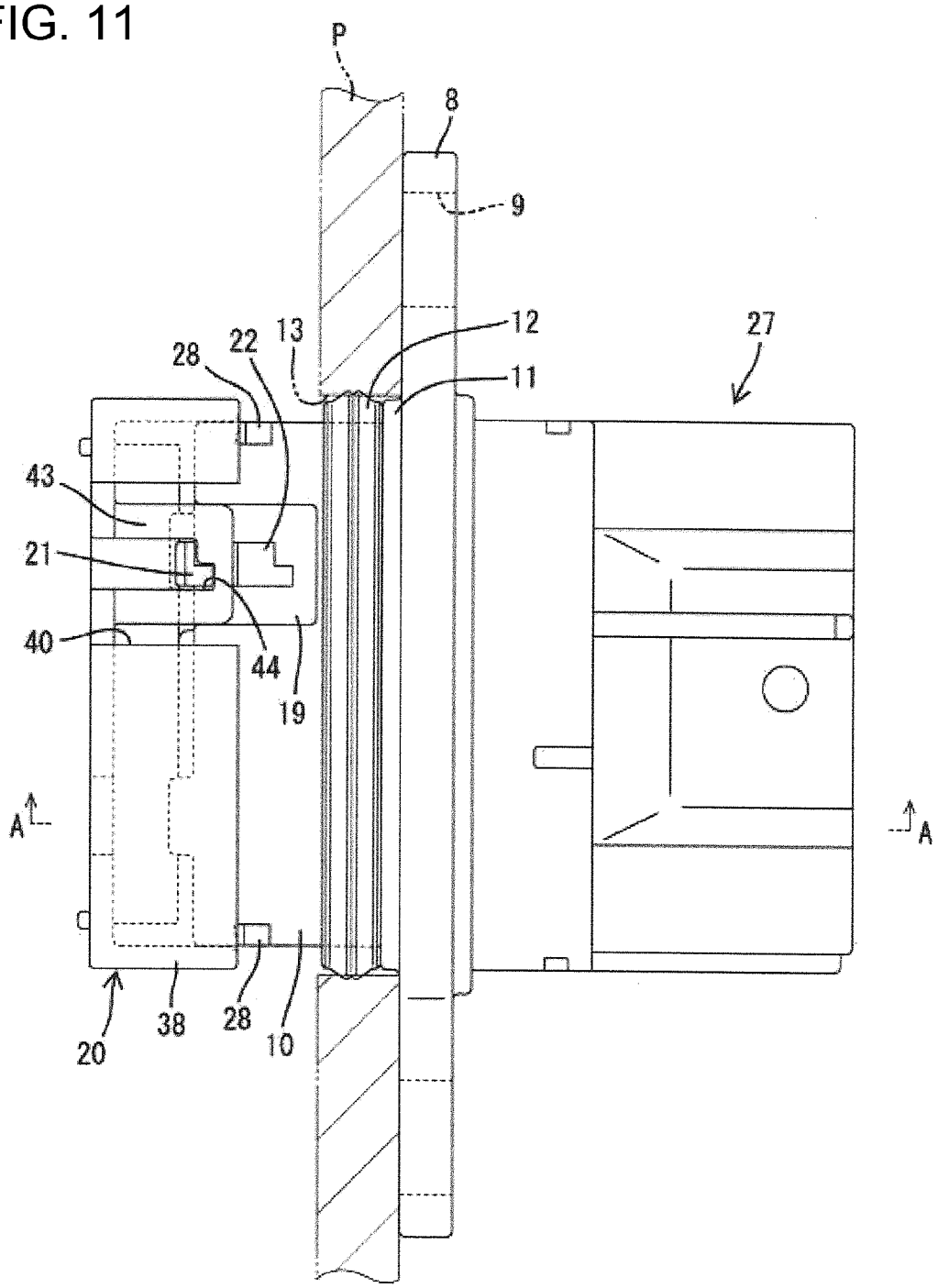
FIG. 11 is a plan view showing a state where the holder is held at a partial locking position on the connector housing.

A rectangular tubular mounting portion 10 is formed in the housing 2 rearward of the flange 8 and is open backward. A step 11 is formed on the outer surface of the mounting portion 10 at a base end part of the flange 8. As shown in FIG. 11, a seal ring 12 is fit on the mounting portion 10 to be pressed against the step 11. The seal ring 12 closely contacts the surface of a connector mounting hole 13 formed in the panel P to seal between the waterproof connector and the panel P.

As shown in FIG. 13, a rubber plug accommodating recess 14 is formed in the mounting portion 10 and a one-piece rubber plug 15 is inserted into the rubber plug accommodating recess 14 from behind until the one-piece rubber plug 15 contacts the back wall. Outer lips 16 are formed on the outer peripheral surface of the one-piece rubber plug 15 and closely contact the peripheral surface of the rubber plug accommodating portion 14. Insertion holes 17 penetrate the one-piece rubber plug 15 in forward and backward directions and are aligned substantially coaxially aligned with the respective cavities 5. Inner lips 18 are formed in each insertion hole 17 for closely contacting the outer peripheral surface of a wire W connected to each terminal fitting 1.

Figure 1:
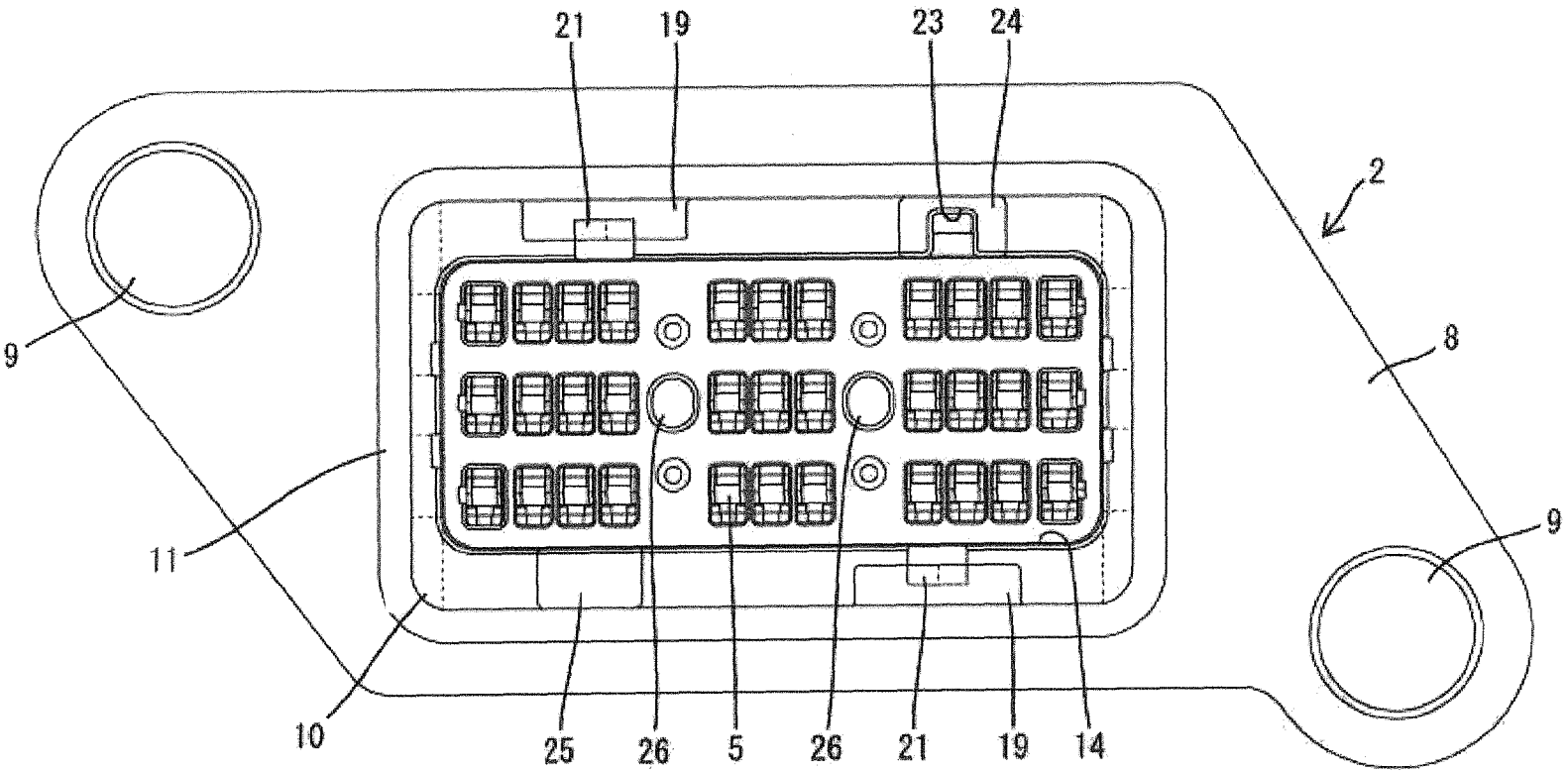
FIG. 1 is a rear view of a connector housing.
Figure 2:
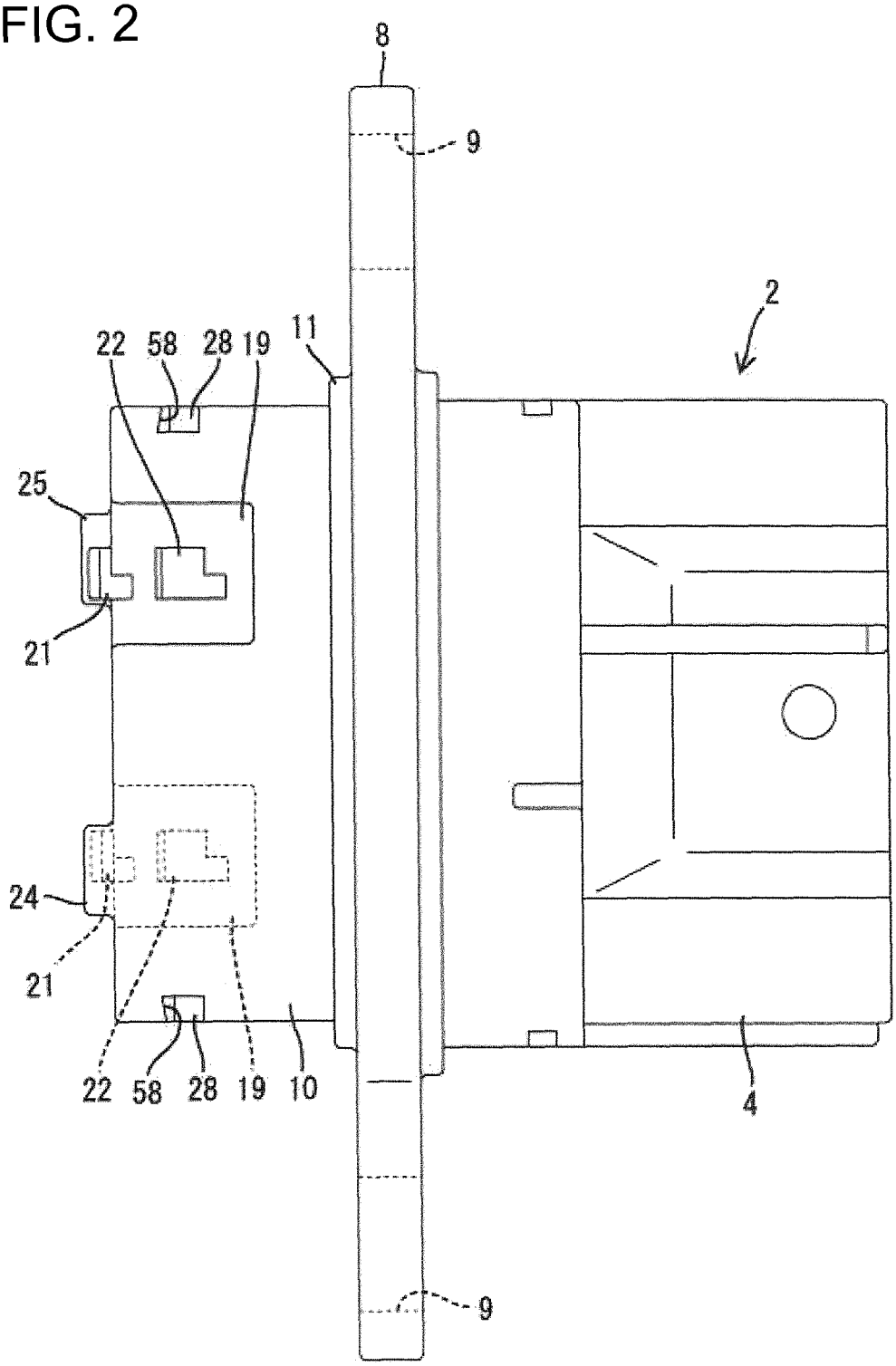
FIG. 2 is a plan view of the connector housing.

Bottomed cutouts 19 are formed at substantially diagonal positions on both upper and lower surfaces of the mounting portion 10, as shown in FIGS. 1 and 2. The cutouts 19 are substantially rectangular in plain view and have an open rear end. A full locking projection 22 and a partial locking projection 21 project one after another on the bottom surface of each cutout 19 for locking a holder 20. The partial locking projection 21 is more rearward and projects back from the rear end of the mounting portion 10. The partial and full locking projections 21 and 22 are key-shaped by having one front corner thereof cut off. Cut-off parts of pairs of key-shaped locking projections located at diagonal positions are facing in the same direction as shown in FIG. 2.

A rearwardly open guide groove 23 is at a diagonal position different from the diagonally disposed partial and full locking projections 21, 22, as shown in FIGS. 1, 2 and 13. The guide groove 23 extends in forward and backward directions of the mounting portion 10 and communicates with the rubber plug accommodating recess 14. The guide groove 23 functions to guide the holder 20 between a partial locking position and a full locking position. An introducing portion 24 of the guide groove 23 projects from the rear end surface of the mounting portion 10. A projection 25 projects from the rear end surface of the mounting portion 10 at a diagonal position to the introducing portion 24 of the guide groove 23.

Left and right receiving holes 26 are arranged at positions of the back wall of the mounting portion 10 circumventing the cavities, as shown in FIG. 1. The receiving holes 26 penetrate into the receptacle 4 in forward and backward directions.

Figure 3:
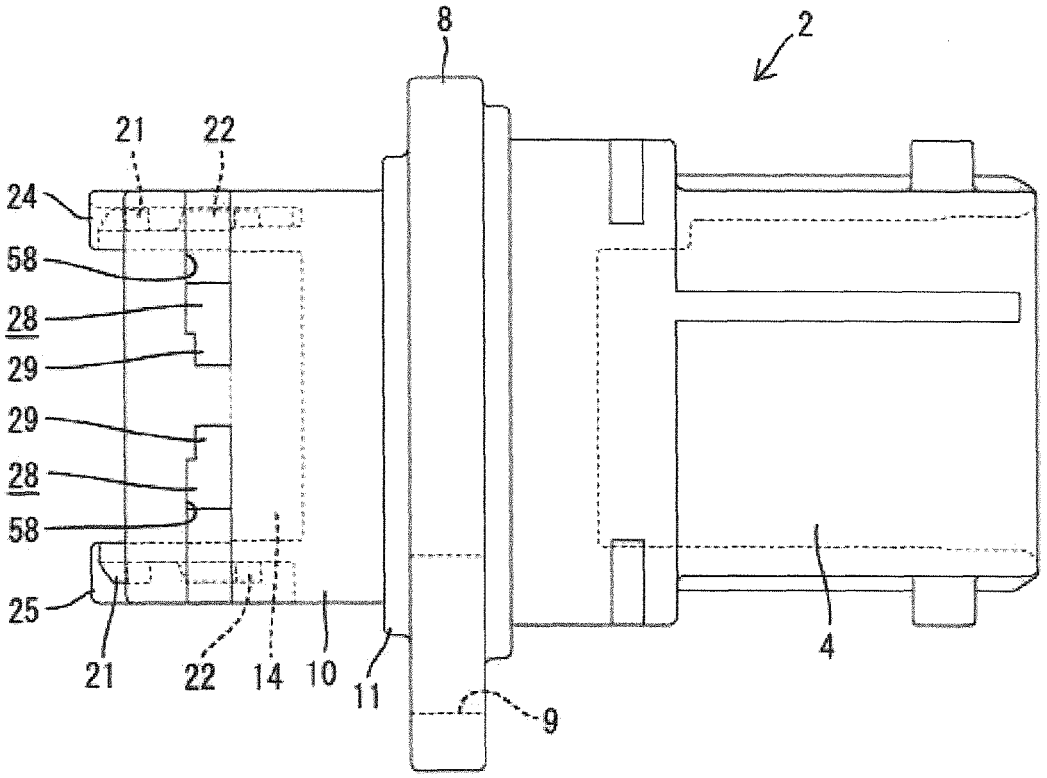
FIG. 3 is a side view of the connector housing.
Figure 18:
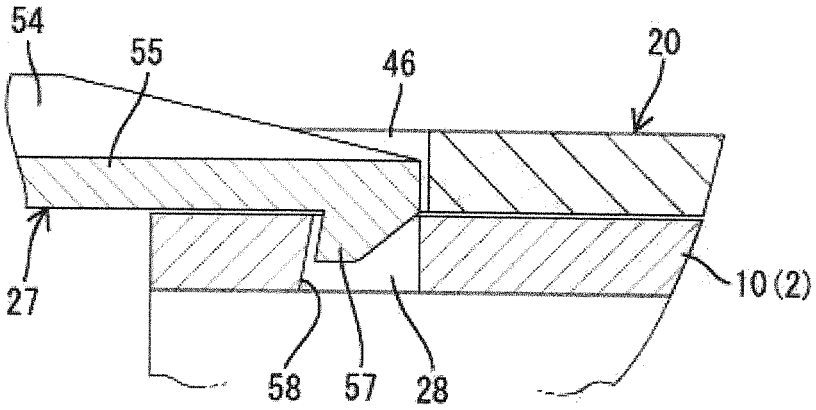
FIG. 18 is a section along B-B of FIG. 17.

Upper and lower engaging portions 28 are arranged on each of both outer side surfaces of the mounting portion 10, as shown in FIG. 3. The engaging portions 28 are in the form of slits having a predetermined length along a height direction. As shown in FIG. 2, each engaging portion 28 is formed by a mold (not shown) removed toward the upper or lower surface of the mounting portion 10 and is bottomed substantially in a half area near a round corner part of the mounting portion 10. A substantially half area at a leading end side is penetrates into the rubber plug accommodating recess 14. A narrowed portion 29 having a small width in forward and backward directions is formed at the leading end (penetration area) of each engaging portion 28. Further, as shown in FIG. 18, the rear side of the opening edge of each engaging portion 28 is tapered surface to widen the engaging portion 28 toward an inner side, and a locking surface 58 is formed on a part of this tapered surface between a penetration area and a non-penetration area of the engaging portion 28.

A pressing member 30 is mounted in the mounting portion 10, as shown in FIG. 13, for preventing a backward displacement of the one-piece rubber plug 15 when the holder 20 is at the partial locking position. The pressing member 30 is a flat lattice that exposes the insertion holes 17 while being held in close contact with the one-piece rubber plug 15. As shown in FIG. 13, reinforcing ribs 32 project from the rear surface of the pressing member 30 along frame edges of the lattice.

A projecting piece 33 projects at a position near one end of the upper edge of the pressing member 30, as shown in FIG. 13, to prevent the pressing member 30 from being mounted in a vertically inverted posture. The projecting piece 33 is inserted into the guide groove 23 of the housing 2 to prevent the mounting of the pressing member 30 in an inverted posture and to guide a mounting operation of the pressing member 30. Two locking claws 34 project sideways from each of the left and right edges of the pressing member 30 and are respectively engageable with the narrowed portions 29 of the engaging portions 28 for retaining purposes.

Figure 16:
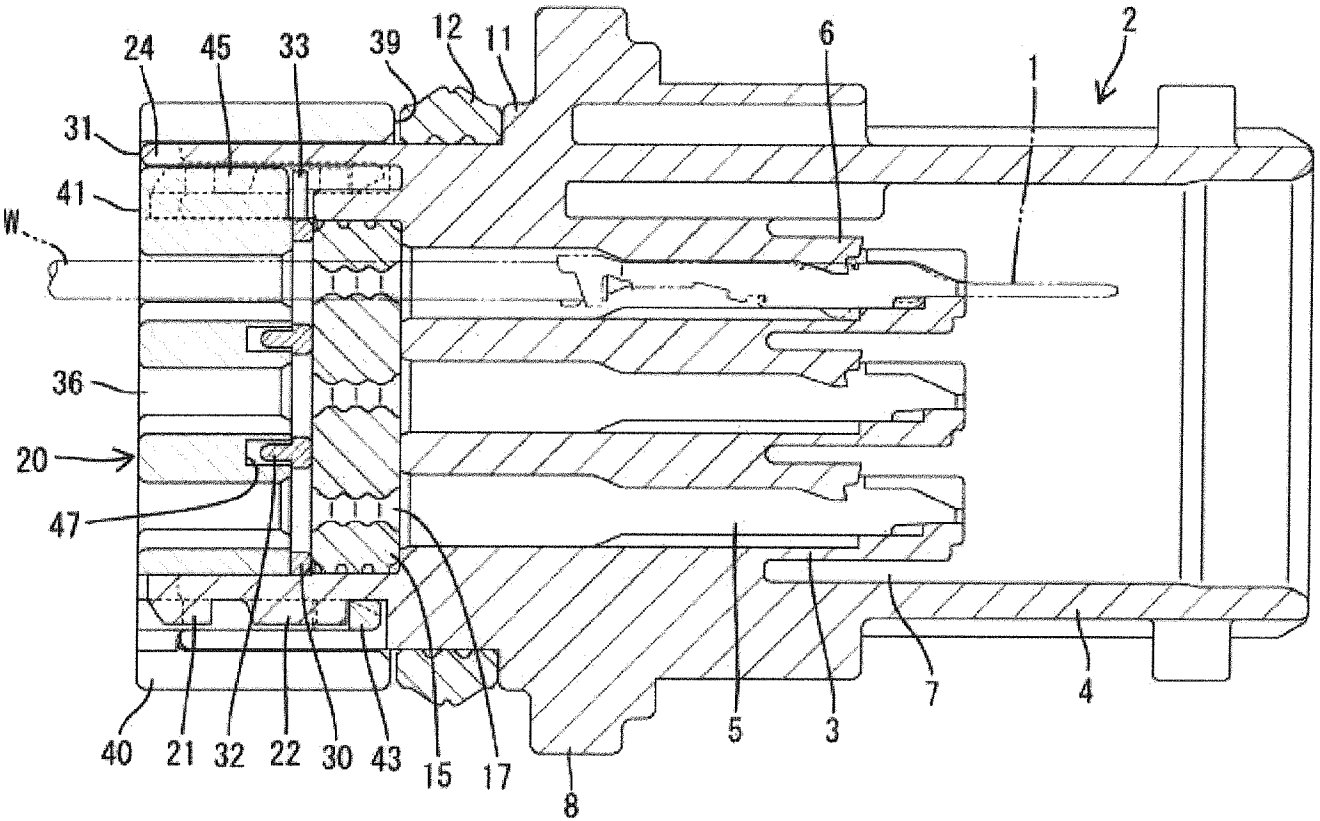
FIG. 16 is a section along A-A of FIG. 11 showing the state of FIG. 14.

The holder 20 is made of synthetic resin and includes a main body 35 to be fit into the rubber plug accommodating recess 14 of the mounting portion 10. At the full locking position shown in FIG. 16, the holder main body 35 closely contacts the rear surface of the pressing member 30 and functions to retain the one-piece rubber plug 15 together with the pressing member 30. The holder main body 35 is formed with a plurality of terminal insertion holes 36 that aligned with the respective cavities 5. Left and right positioning shafts 37 project forward from the front surface of the main body 35 for holding a mounting posture of the holder 20 relative to the housing 2. These positioning shaft portions 37 penetrate through the pressing member 30 and the one-piece rubber plug 15 and are inserted into the receiving holes 26 of the housing 2.

Figure 5:
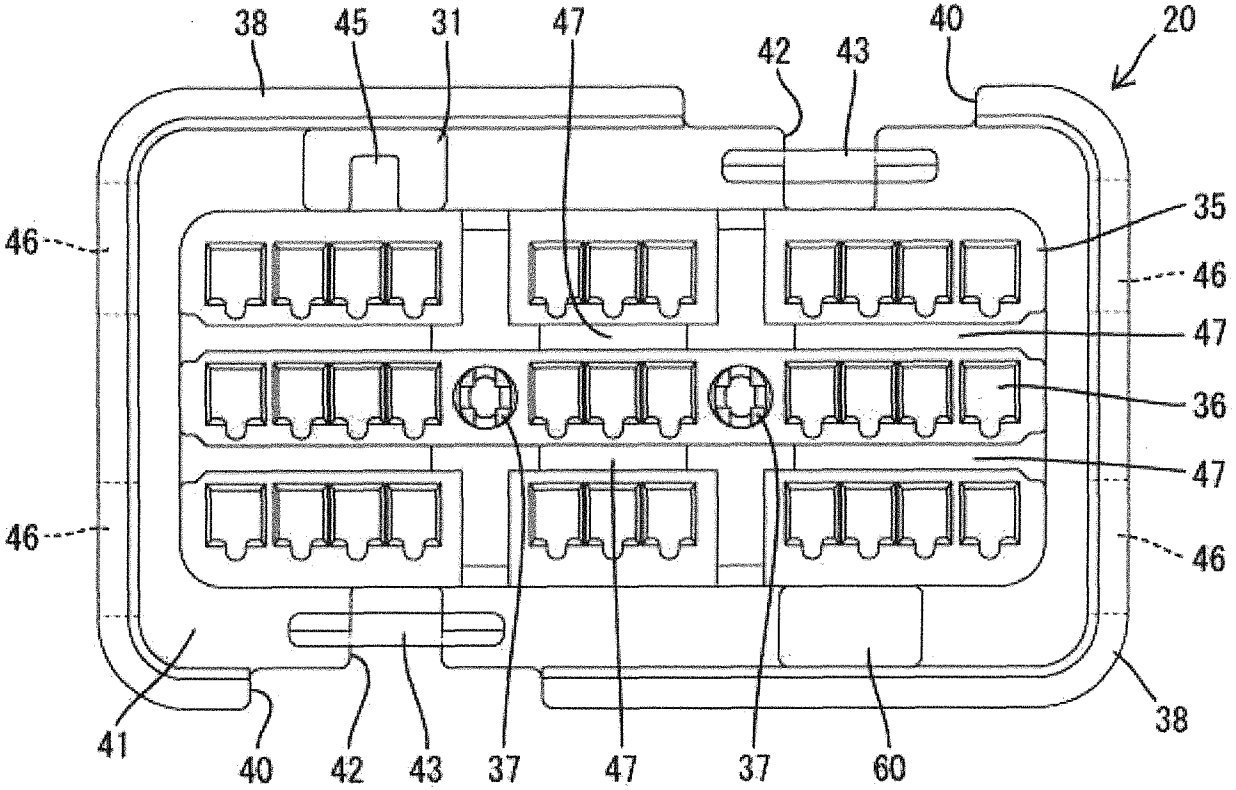
FIG. 5 is a front view of the holder.
Figure 14:
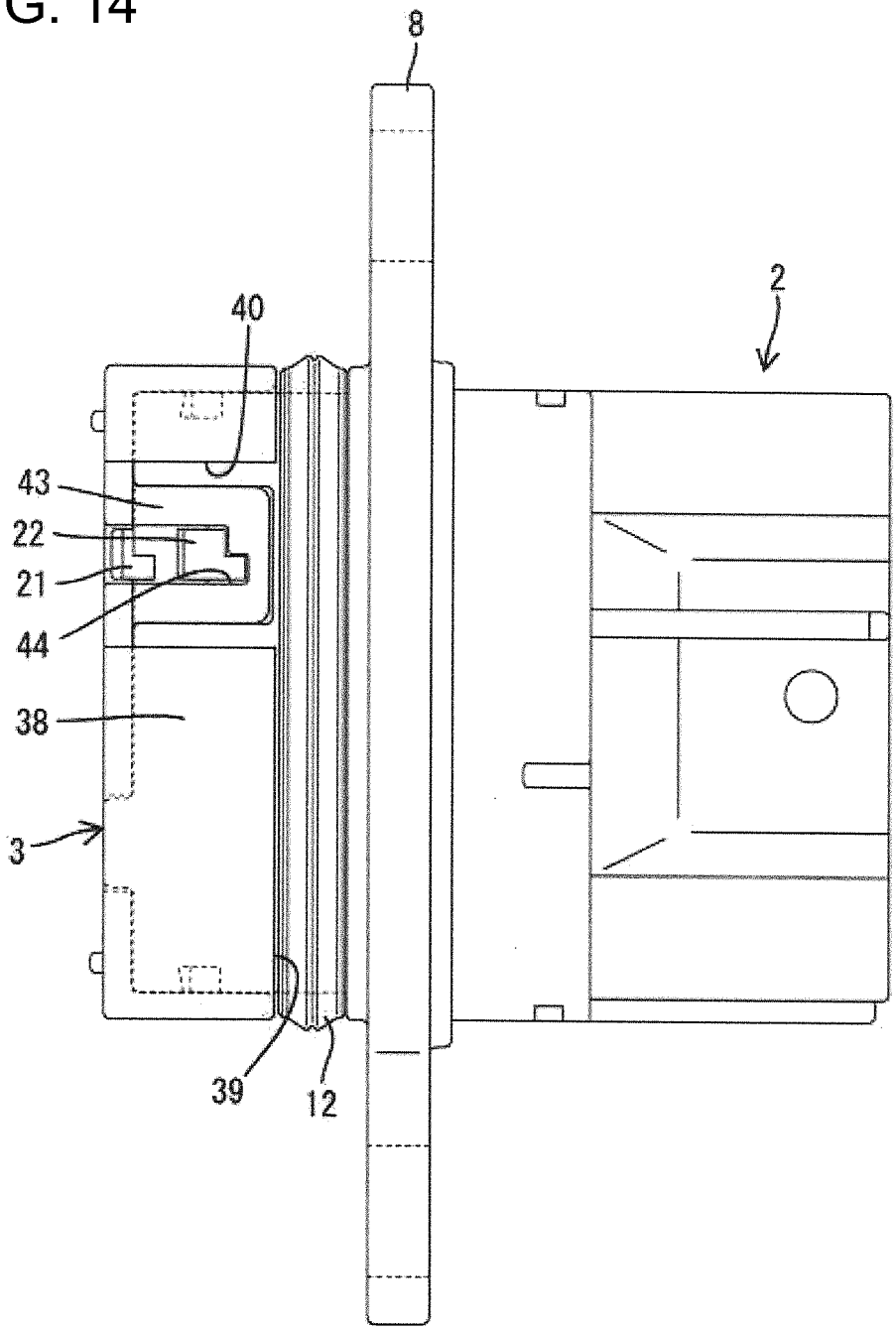
FIG. 14 is a plan view showing a state where the holder is held at a full locking position on the connector housing.
Figure 15:
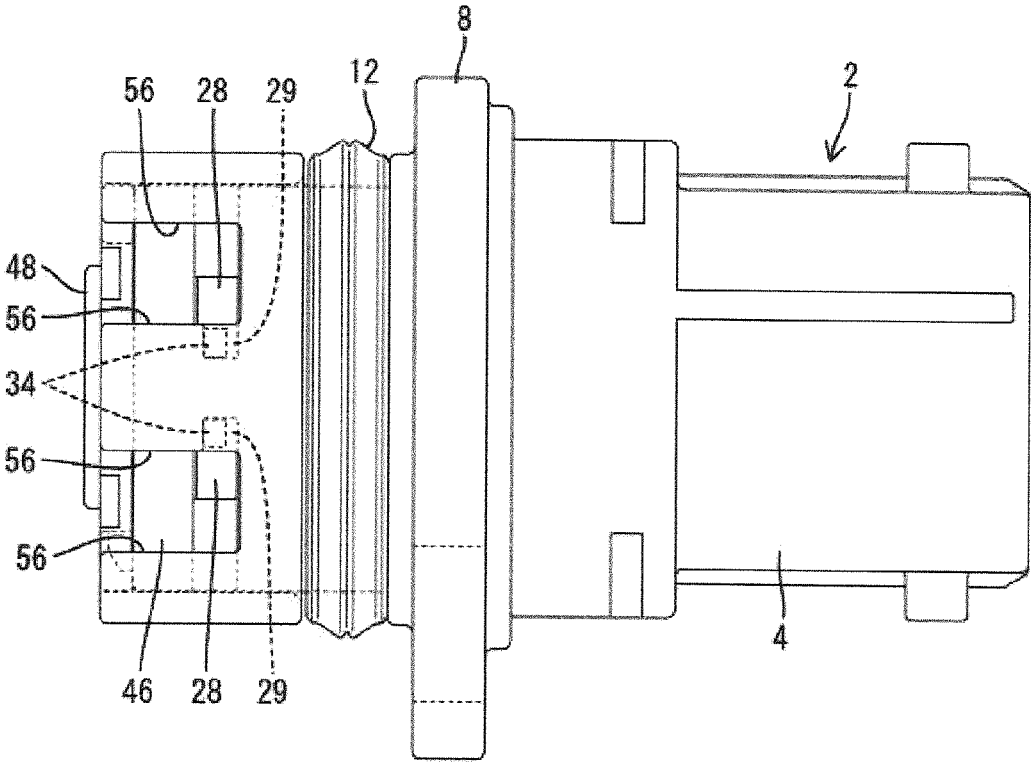
FIG. 15 is a side view showing the state of FIG. 14.

A peripheral wall 38 surrounds the main body 35 of the holder 20 and a rear wall 41 connects the peripheral wall 38 and the main body 35, as shown in FIG. 5. The peripheral wall 38 defines a fitting portion and the mounting portion 10 can be fit into the inside of the peripheral wall 38. As shown in FIGS. 14 and 15, the leading end of the peripheral wall 38 has a pressing edge 39 that faces the rear end surface of the seal ring 12 when the holder 20 is at the full locking position. Further, cut grooves 40 are arranged at diagonal positions of the peripheral wall 38 facing the diagonal positions that have the partial locking projections 21 and the full locking projections 22. The cut grooves 40 have a constant width from the front end to the back wall of the peripheral wall 38.

Figure 4:
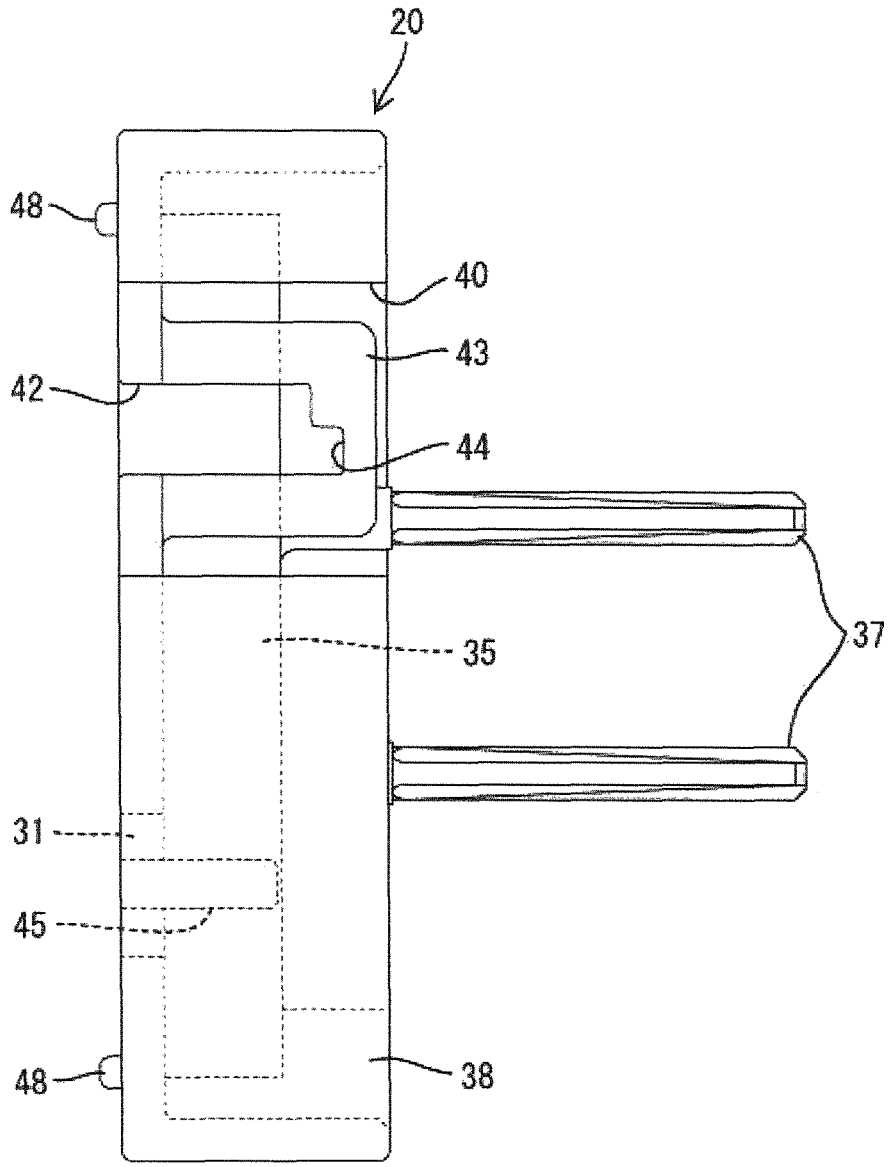
FIG. 4 is a plan view of a holder.
Figure 7:
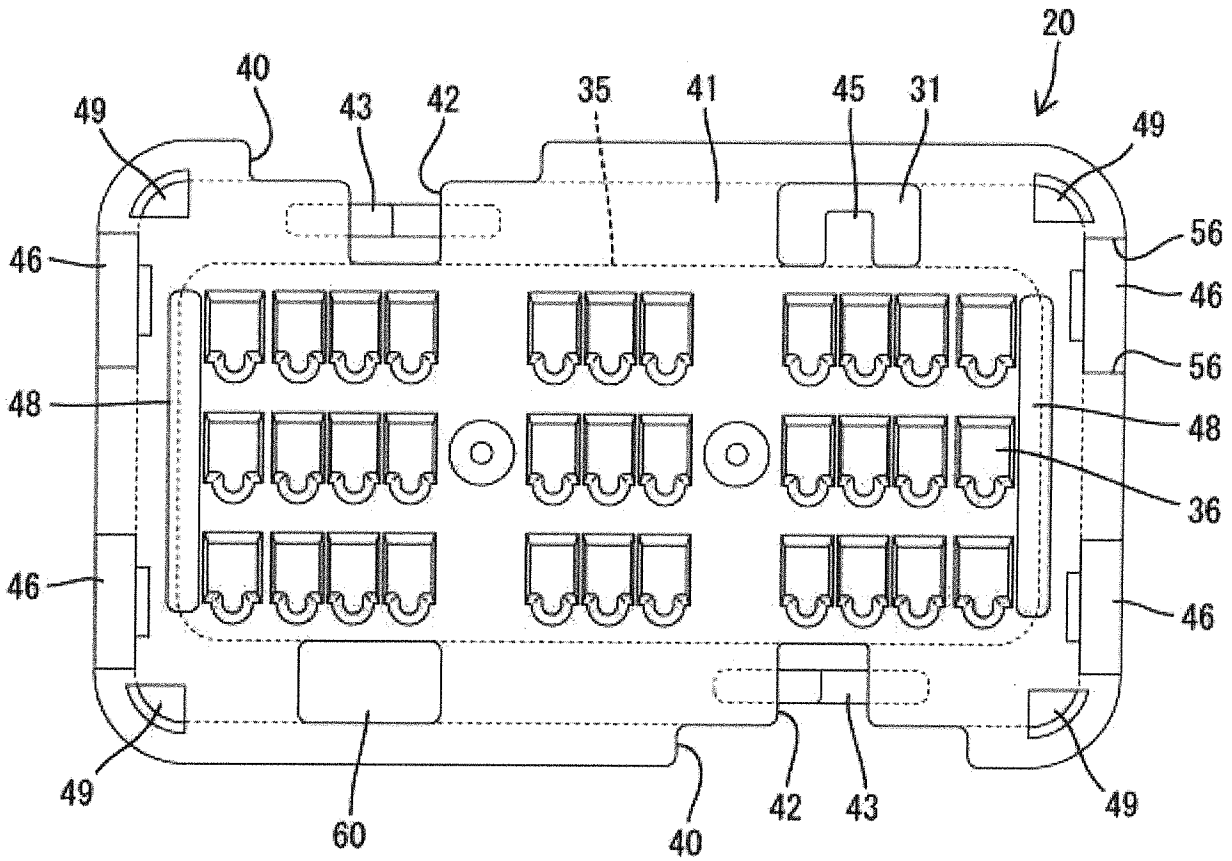
FIG. 7 is a rear view of the holder.
Figure 8:
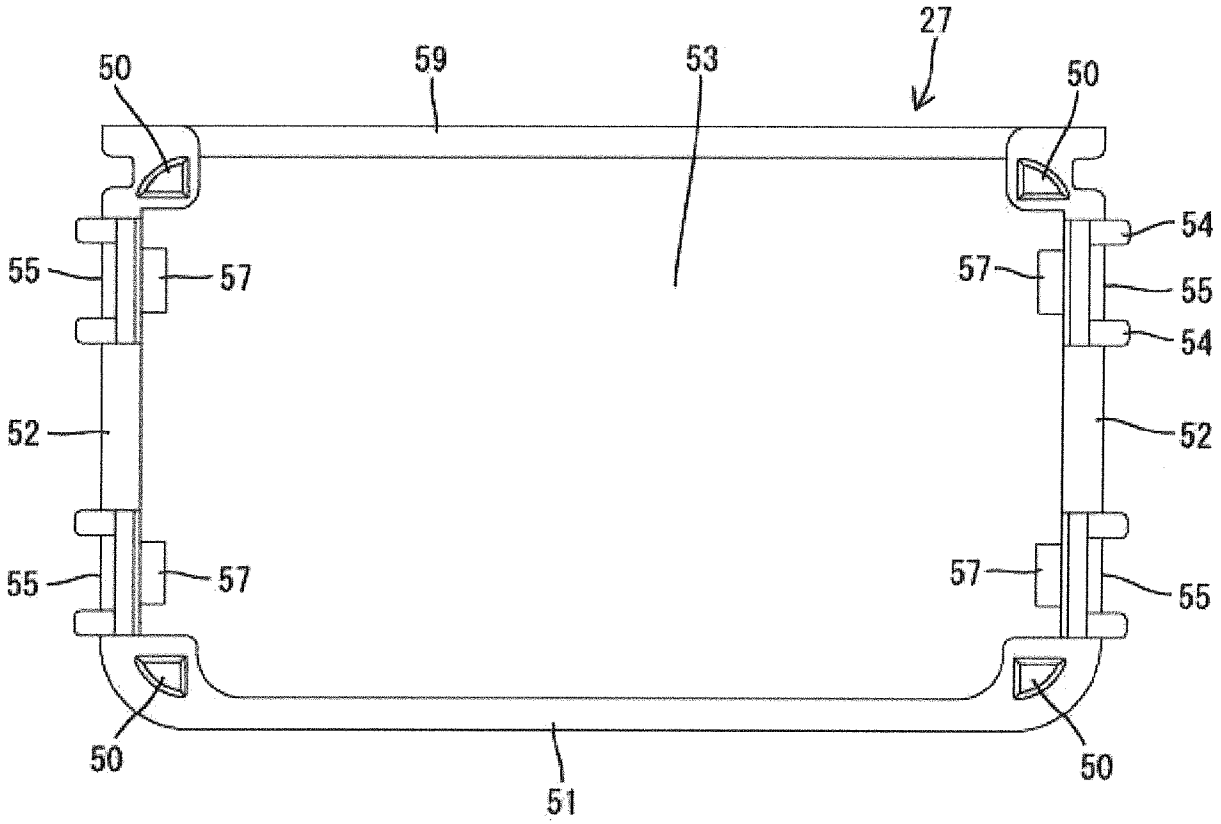
FIG. 8 is a front view of a cover.

As shown in FIGS. 5 and 7, the rear wall 41 has narrow vertical grooves 42 communicating with the cut grooves 40 and having a depth to reach the outer surface of the main body 35. Ends of a locking arm 43 crossing over the vertical groove 42 are connected at a height position between the peripheral wall 38 and the main body 35. As shown in FIG. 4, the locking arm 43 is substantially U-shaped in a plan view, and the leading end of the locking arm 43 projects from the holder main body 35, but is located at a position slightly retracted from the front end of the peripheral wall 38. The locking arm 43 is resiliently deformable in the height direction. A locking step 44 is formed at an inner leading end part of the locking arm 43 and can fit to the key shape of the partial and full locking projections 21 and 22 of the housing 2. As shown in FIG. 11, in a state where the locking step 44 is engaged with the partial locking projection 21 (partial locking position), the leading end surface of the locking arm 43 is in contact with the rear end surface of the full locking projection 22 to prevent both backward and forward movements of the holder 20. Further, as shown in FIG. 14, the partial locking projection 21 also is fit into the inside of the locking arm 43 in a state where the locking step 44 is fit to the full locking projection 22 (full locking position).

As shown in FIGS. 5 and 7, an elongated projection 45 is provided on the outer surface of the main body 35 at a position corresponding to the guide groove 23 of the housing 2. The elongated projection 45 is formed over the entire length of the main body 35, as shown in FIG. 13. A part of the leading end of the elongated projection 45 is before the entrance of the introducing portion 24 of the guide groove 23 when the holder 20 is at the partial locking position. The elongated projection 45 then moves forward while being engaged with the guide groove 23 until the holder 20 reaches the full locking position. An escaping window 31 is formed in the rear wall 41 around the rear end surface of the elongated projection 45. The introducing portion 24 of the guide groove 23 fits into the escaping window 31 when the holder 20 is at the full locking position. In this way, the rear surface of the rear wall 41 and the rear end surface of the introducing portion 24 are substantially flush (see FIG. 16).

A locking window 60 is formed at a diagonal position to the elongated projection 45 in the rear wall 41. When the holder 20 is at the full locking position, the locking widow 60 engages the projection 25 of the housing 2 and the rear end surfaces of the rear wall 41 and the projection 25 are substantially flush in the engaged state.

Figure 6:
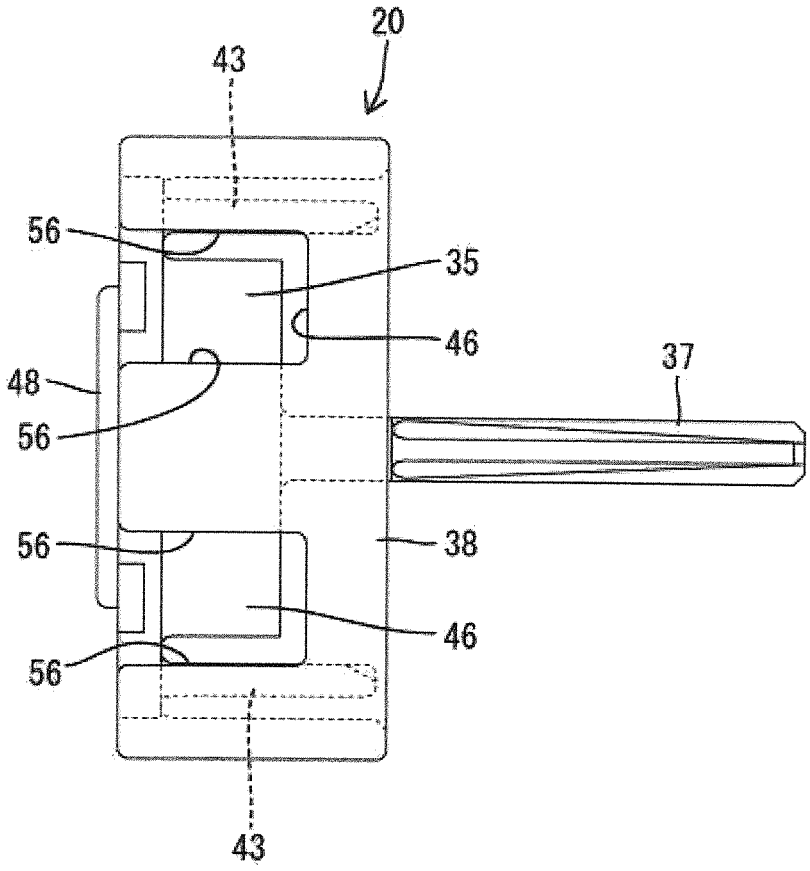
FIG. 6 is a side view of the holder.
Figure 12:
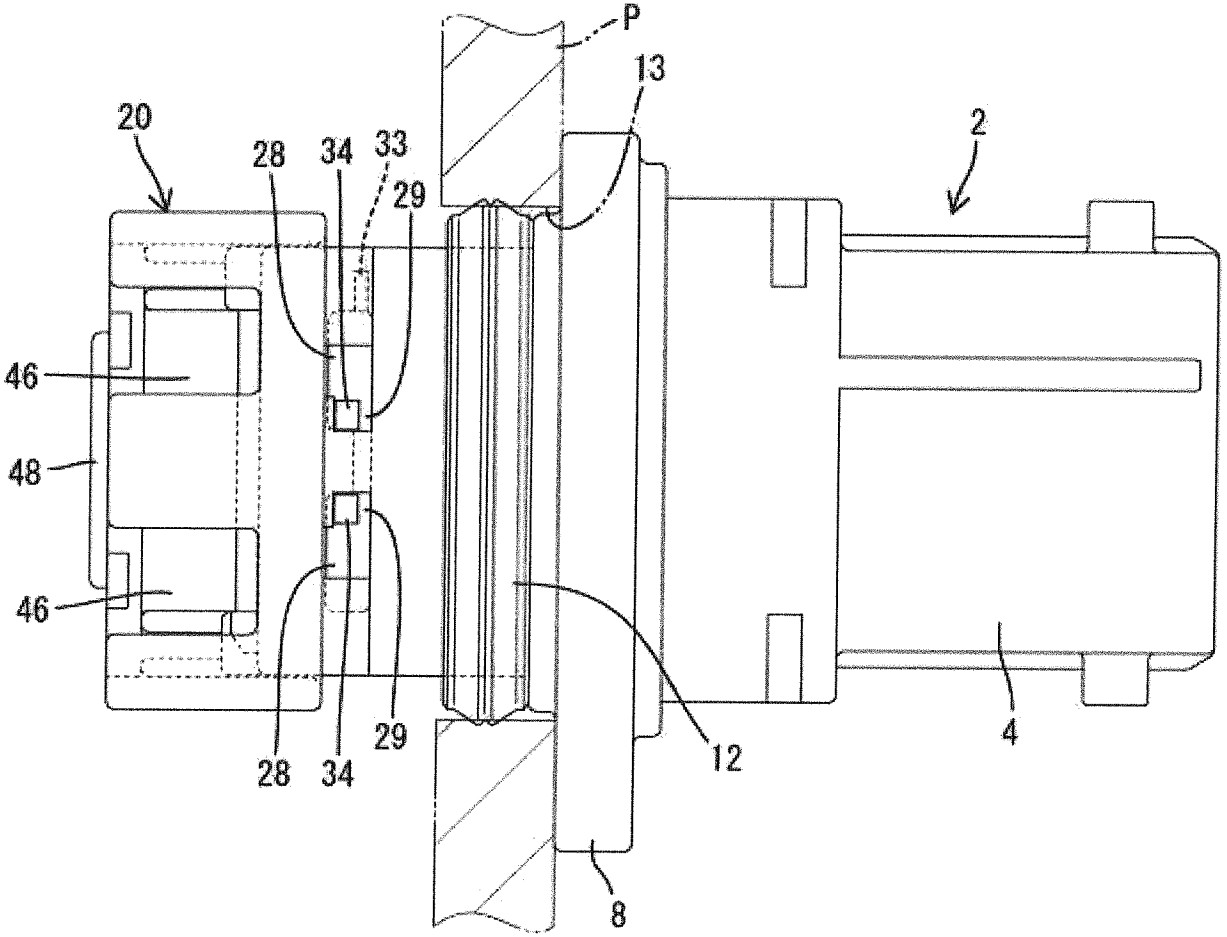
FIG. 12 is a side view showing the state of FIG. 11.

Upper and lower openings 46 are formed on each of the left and right surfaces of the peripheral wall 38, as shown in FIG. 6, and correspond to the respective engaging portions 28 of the housing 2. Each opening 46 is rectangular and opens toward the rear wall 41. As shown in FIG. 12, the openings 46 are behind the engaging portions 28 of the housing 2 when the holder 20 is at the partial locking position. However, as shown in FIG. 15, the openings 46 overlap parts of the upper and lower engaging portions 28 above or below the narrowed portions 29 when the holder 20 is at the full locking position. Thus, when the holder 20 is at the full locking position, predetermined height ranges of the upper and lower engaging portions 28 are exposed over substantially the entire width in forward and backward directions.

The front surface of the main body 35 has recessed escaping grooves 47, as shown in FIG. 5, for avoiding interference with the respective reinforcing ribs 32 of the pressing member 30 when the holder 20 is in close contact with the pressing member 30. On the other hand, as shown in FIG. 7, two vertical ribs 48 are formed on the rear surface of the rear wall 41 to project outside a formation area of the terminal insertion holes 36.

Figure 17:
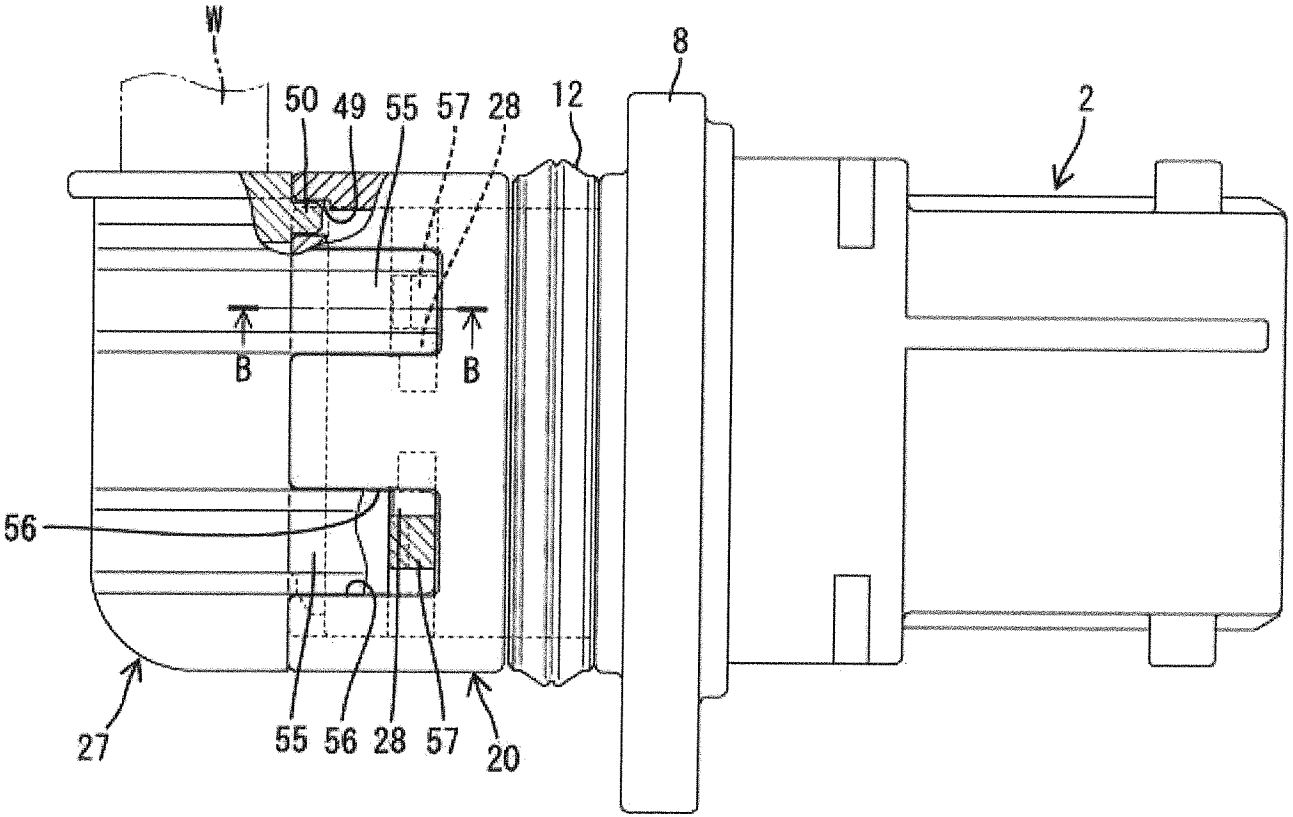
FIG. 17 is a side view partly in section showing a state where the cover is mounted.

Positioning recesses 49 are formed on four corners of the rear wall 41, as shown in FIG. 7. Each positioning recess 49 has a fan shape of a substantially 90°. As shown in FIG. 17, corresponding positioning projections 50 of the cover 27 are inserted into the positioning recesses 49 to prevent the cover 27 from being displaced in a direction perpendicular to a mounting direction.

The cover 27 also is made of synthetic resin and includes a bottom plate 51, left and right side plates 52 and a back plate 53. An upper side of the cover 27 defines a pull-out opening 59 for the wires W. The front end edges of the bottom plate 51 and both side plates 52 are substantially flush and are held in contact with a peripheral edge of the rear wall 41 of the holder 20 when the cover 27 is mounted (see FIG. 17).

The positioning projections 50 are arranged on four corners of the front of the cover 27 to correspond to the positioning recesses 49 of the holder 20. The positioning projections 50 project forward and can be inserted into the respective positioning recesses 49 of the holder 20 when the cover 27 is mounted properly.

Figure 9:
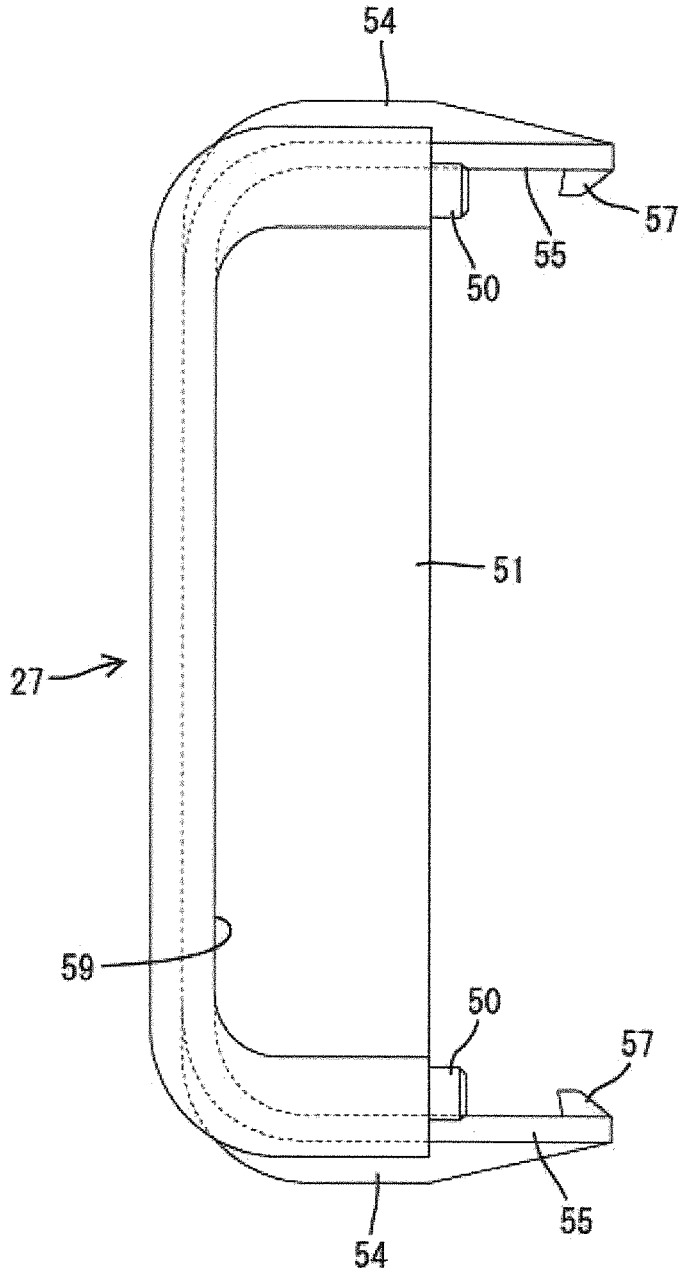
FIG. 9 is a plan view of the cover.
Figure 10:
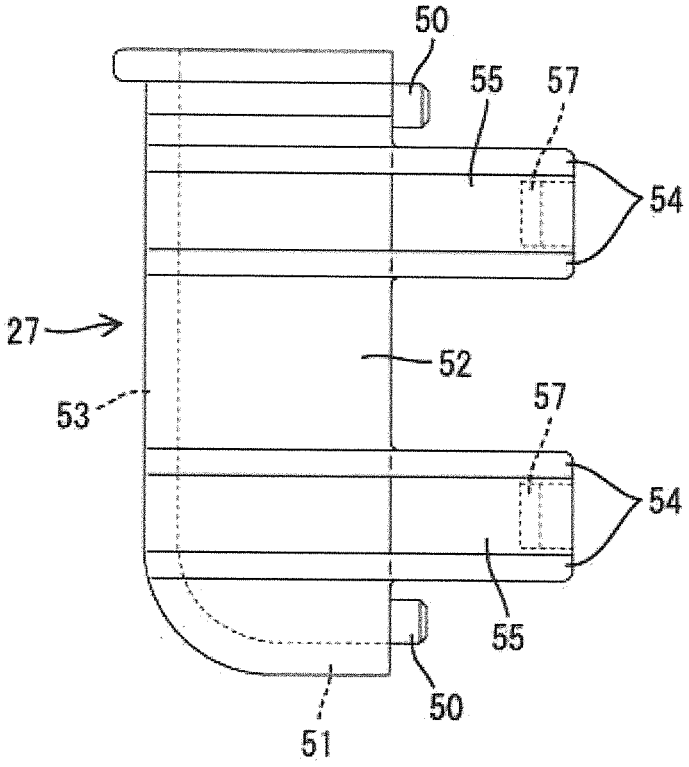
FIG. 10 is a side view of the cover.

Upper and lower lock arms 55 are arranged on each of the left and right side plates 52, as shown in FIG. 10. Each lock arm 55 projects forward from the side plate 52 and reinforcing edges 54 project out on both upper and lower edges of the outer surface of each lock arm 55 over the entire length to the back plate 53. However, as shown in FIG. 9, the projecting height of the reinforcing edges 54 is reduced gradually toward the leading ends in a range of the lock arms 55 projecting from the side plates 52 to permit outward deformations of parts of the lock arms 55 projecting from the side plates 52.

The width of each lock arm 55 in the height direction substantially equals the width of the corresponding opening 46 of the holder 20 in the height direction. Upper and lower guiding edges 56 are defined at the openings 46 of the holder 20 and guide displacements of the lock arms 55 when the cover 27.

An inwardly projecting lock claw 57 is formed at the leading end of each lock arm 55. The lock claws 57 engage the opening edges of the engaging portions 28 exposed through the openings 46 when the cover 27 reaches a proper mounting position (see FIG. 17). As shown in FIG. 18, the width of the base ends of the lock claws 57 in forward and backward directions is slightly shorter than the opening width of the engaging portions 28 in forward and backward directions. Accordingly, the openings 46 cannot expose the engaging portions 28 over the entire width (in forward and backward directions) so that the lock claws 57 cannot engage the engaging portions 28 if the holder 20 has not reached the proper mounting position.

To assemble the waterproof connector of this embodiment, the terminal fitting 1 first is inserted from behind in a state where the holder 20 is at the partial locking position, as shown in FIG. 13. Each terminal fitting 1 is inserted through the insertion hole 36 of the holder 20, through the pressing member 30 and the insertion hole 17 of the one-piece rubber plug 15 and into the cavity 5. The terminal fitting 1 retained by the locking lance 6 upon reaching a proper position in the cavity 5.

The holder 20 is pushed and moved to the full locking projection after all of the terminal fittings 1 are inserted. Thus, lock arms 43 disengage the partial locking projections 21 and engage the full locking projections 22 at the full locking position to retain the holder 20. The respective ribs 32 of the pressing member 30 are fit into the escaping grooves 47 of the main body 35 when the holder 20 is at the full locking position so that the front surface of the main body 35 is in close contact with the pressing member 30. Simultaneously, the pressing edge 39 on the leading end of the peripheral wall 38 is in contact with the seal ring 12 to retain the seal ring 12. On the other hand, the engaging portions 28 are exposed over the entire width in forward and backward directions through the corresponding openings 46 of the holder 20 when the holder 20 is at the full locking position.

The cover 27 is mounted behind the holder 20 and the lock claws 57 are inserted through the entrances of the corresponding openings 46. At that time, the wires W pulled out from the holder 20 are bundled, bent up and pulled out from the wire pull-out opening 59 of the cover 27. The guiding edges 56 of the openings 46 guide the lock arms 55 and hold the lock arms 55 in a horizontal mounting posture as the cover 27 is moved further forward. The respective lock claws 57 engage the opening edges of the engaging portions 28 exposed through the openings 46 when the front edges of the bottom plate 51 and the side plates 52 of the cover 27 contact the rear wall 41 of the holder 20, as shown in FIG. 18.

The cover 27 of the assembled connector is not engaged with the holder 20, but directly engages the housing 2 through the openings 46 of the holder 20. Thus, a larger holding force can be obtained as compared with the case where the cover 27 is engaged with the holder 20. Further, the respective positioning projections 50 of the properly mounted cover 27 are inserted into the corresponding positioning recesses 49 of the holder 20 to prevent displacement of the cover 27 in a direction perpendicular to the mounting direction and to increase the holding force for the cover 27.

Figure 19:
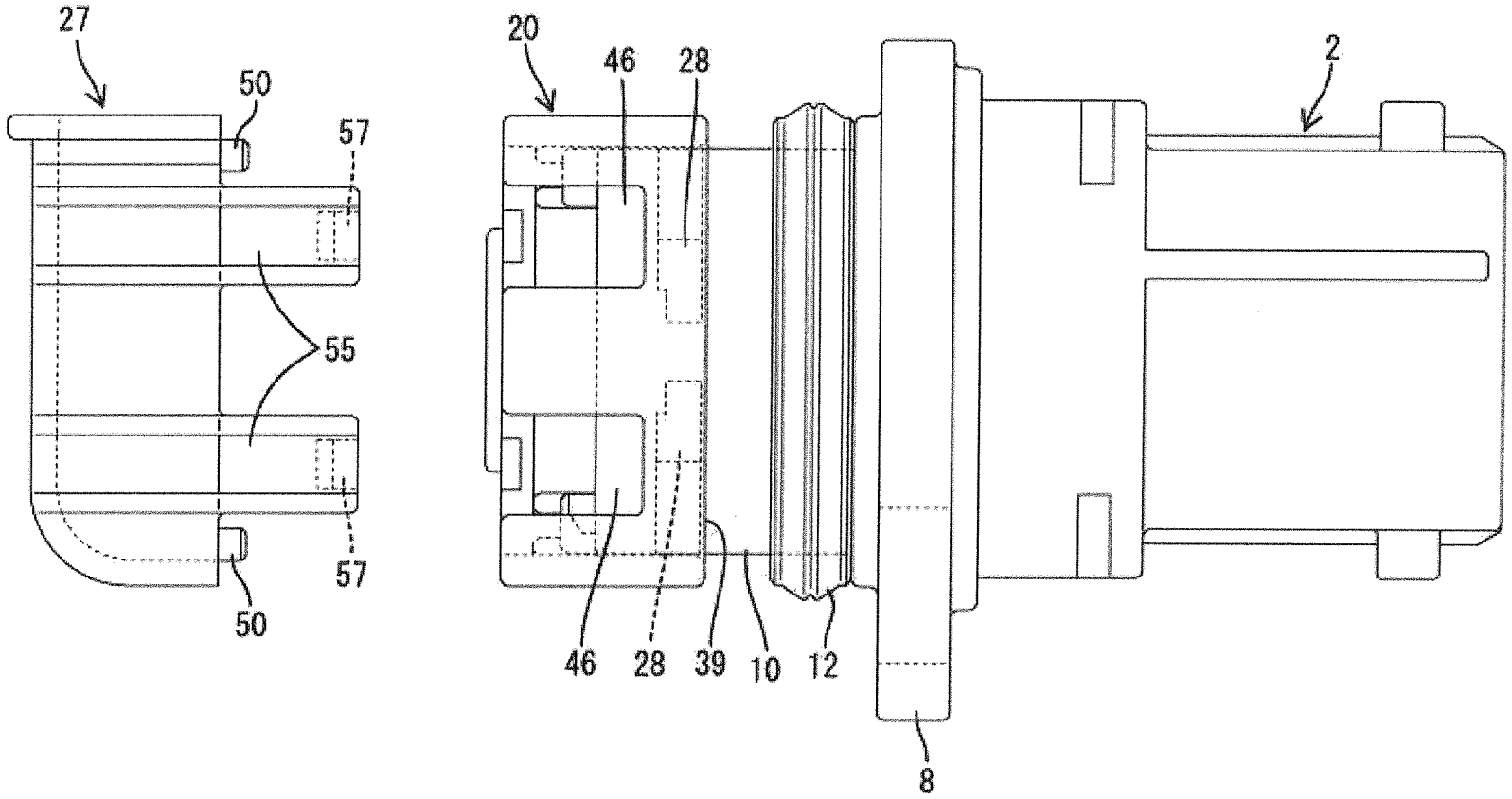
FIG. 19 is a side view showing an incompletely mounted state of the holder.

An incompletely mounted holder 20 at least partly covers the engaging portions 28, as shown in FIG. 19. Accordingly, even if it is tried to mount the cover 27 in this state, the lock claws 57 cannot engage the engaging portions 28 and are left deformed. An operator can understand that the holder 20 is in an incompletely mounted state when the cover 27 cannot be locked in this way.

An attempt could be made to mount the cover 27 when the holder 20 is at the partial locking position. The engaging portions 28 are exposed as shown in FIG. 12, but the cover 27 comes into contact with the rear wall 41 of the holder 20 and cannot move any farther forward. Thus, the lock claws 57 cannot reach the engaging portions 28. Accordingly, the lock claws 57 and the engaging portions 28 cannot be engaged as in the above case, and the operator can understand that the holder 20 is not mounted properly.

The one-piece rubber plug 15 and the seal ring 12 are retained by the holder 20 thereby reducing the number of parts.

The invention is not limited to the above described embodiment. For example, the following embodiments are also in the scope of the invention.

Although the waterproof connector to be mounted on the panel P is illustrated in the above embodiment, the application of the present invention is not limited to waterproof connectors of a panel mount type.

The waterproof connector of the present invention needs not necessarily include the seal ring 12.

Although the holder 20 is held at two positions, i.e. at the partial locking position and the full locking position relative to the connector housing 2 in the above embodiment, the partial locking position may not be set.

Although the engaging portions 28 serve to lock the cover 27 and lock the pressing member 30 to consolidate the configuration in the above embodiment, locking portions may be separately provided.

What is claimed is:

1. A waterproof connector, comprising:

a housing with opposite front and rear ends and an outer surface extending between the front and rear ends, a recess extending into the rear end, areas of the housing forward of the recess being configured for accommodating a plurality of terminal fittings connected to ends of respective wires, at least one engaging portion formed on the outer surface of the housing;

a one-piece rubber plug mounted into the recess at the rear end of the housing to collectively seal the wires;

a holder fit on the rear end of the housing and having a main body configured to retain the one-piece rubber plug in the recess, the holder having a peripheral wall telescoped over the outer surface at the rear end of the housing, the peripheral wall being formed with an opening that exposes the engaging portion of the housing when the holder is mounted properly on the housing; and a cover arranged on a rear part of the holder, the cover being formed with at least one lock engageable with the at least one engaging portion exposed at the opening of the holder.

2. The waterproof connector of claim 1, wherein the peripheral wall of the holder at least partly covers the engaging portion to prevent the lock from engaging the engaging portion when the holder is mounted incompletely.

3. The waterproof connector of claim 2, wherein:

the holder is mounted on the housing to be displaceable between a partial locking position where the holder is spaced back from the one-piece rubber plug and a full locking position where the holder is substantially in close contact with a rear surface of the one-piece rubber plug.

4. The waterproof connector of claim 3, wherein the at least one opening is at a position to prevent the lock from engaging the engaging portion when the holder is at the partial locking position; and the opening is at a position to enable the lock to engage the engaging portion when the holder is at the full locking position.

5. The waterproof connector of claim 1, wherein the lock is on a lock arm that projects forward in a mounting direction of the cover.

6. The waterproof connector of claim 1, further comprising a guiding edge formed on the at least one opening and extending along the mounting direction of the cover, the guiding edge sliding in contact with the lock arm when the cover is mounted for guiding a mounting movement of the cover.

7. The waterproof connector of claim 1, wherein at least one projection and at least one positioning recess are formed on facing surfaces of the cover and the holder in a mounting direction of the cover, the projection and the positioning recess being engageable with each other when the cover is mounted on the housing.

8. The waterproof connector of claim 7, wherein the projection is on the cover and the positioning recess is on the holder.

9. The waterproof connector of claim 1, further comprising a seal ring is mounted on an outer peripheral surface of the housing.

10. The waterproof connector of claim 9, wherein a pressing edge is formed on a front end of the holder in the mounting direction for retaining the seal ring by facing a rear edge of the seal ring in the mounting direction when the holder is mounted properly on the housing.

11. The waterproof connector of claim 1, wherein the at least one engaging portion is a slot formed in the outer surface of the housing.

12. The waterproof connector of claim 1, wherein the at least one engaging portion is a first engaging portion, and the housing further being formed with a second engaging portion, the opening in the holder being a first opening and the holder having a second opening, the first and second openings being at positions to expose the first and second engaging portions when the holder is mounted properly on the housing.

13. The waterproof connector of claim 12, wherein the at least one lock on the cover is a first lock, and the cover further being formed with a second lock, the first and second locks being engageable with the first and second engaging portions.

14. The waterproof connector of claim 1, wherein the cover is configured to hold the wire in a non-linear shape rearward of the housing.

* * * * *